US007933536B2

(12) United States Patent
Ogawa

(10) Patent No.: US 7,933,536 B2
(45) Date of Patent: Apr. 26, 2011

(54) IMAGE FORMING DEVICE

(75) Inventor: Daisuke Ogawa, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 534 days.

(21) Appl. No.: 12/133,790

(22) Filed: Jun. 5, 2008

(65) Prior Publication Data

US 2008/0304861 A1 Dec. 11, 2008

(30) Foreign Application Priority Data

Jun. 7, 2007 (JP) ..... 2007-151783

(51) Int. Cl.
*G03G 15/00* (2006.01)
*G03G 21/18* (2006.01)

(52) U.S. Cl. ..... 399/111; 399/167

(58) Field of Classification Search ..... 399/110, 399/111, 167
See application file for complete search history.

(56) References Cited

U.S. PATENT DOCUMENTS

| | | | | |
|---|---|---|---|---|
| 6,400,914 | B1 * | 6/2002 | Noda et al. | 399/90 |
| 6,405,004 | B2 * | 6/2002 | Matsuzaki et al. | 399/111 |
| 6,795,671 | B2 | 9/2004 | Matsuoka | |
| 6,999,696 | B2 * | 2/2006 | Noda et al. | 399/90 |
| 7,006,776 | B2 * | 2/2006 | Matsuzaka et al. | 399/111 |

FOREIGN PATENT DOCUMENTS

| | | | |
|---|---|---|---|
| JP | 06-258877 | | 9/1994 |
| JP | 10-254327 | | 9/1998 |
| JP | 2000-330455 | | 11/2000 |
| JP | 2003-208024 | | 7/2003 |
| JP | 2005-055631 | | 3/2005 |
| JP | 2007178656 | A * | 7/2007 |

OTHER PUBLICATIONS

Notice of Reasons of Rejection for Japanese Application No. 2007-151783; Mailing Date May 12, 2009.

* cited by examiner

*Primary Examiner* — David M Gray
*Assistant Examiner* — Fred Braun
(74) *Attorney, Agent, or Firm* — Banner & Witcoff, Ltd.

(57) ABSTRACT

An image forming device includes a driving mechanism that transmits a driving force to a process cartridge through an input portion of the process cartridge. The driving mechanism includes a drive shaft shifting between a state engaging with the input portion and a state spaced from the input portion, a first cam joined with a door to be rotated with movement of the door, the first cam including a first sliding surface, a translation member including a sliding contact portion which slidably contacts the first sliding surface, the translation member being configured to engage with the drive shaft and shift together with the drive shaft with the sliding contact portion sliding on the first sliding surface with rotation of the first cam, and a second cam including a second sliding surface which slidably contacts the sliding contact portion to face the first sliding surface through the sliding contact portion.

10 Claims, 11 Drawing Sheets

IMAGE FORMING DEVICE

CROSS-REFERENCE TO RELATED APPLICATION

This application claims priority under 35 U.S.C. §119 from Japanese Patent Application No. 2007-151783 filed on Jun. 07, 2007. The entire subject matter of the application is incorporated herein by reference.

BACKGROUND

1. Technical Field

The following description relates to one or more image forming devices configured to form an image on a recording sheet based on an electrophotographic technology.

2. Related Art

As is commonly known, an electrophotographic image forming device is configured to form an image on a recording sheet by forming an electrostatic latent image on a photoconductive body with an exposure unit such as an LED and laser beam scanner, then supplying developer to the photoconductive body with the electrostatic latent image formed thereon so as to form a developer image, and thereafter transferring the developer image onto the recording sheet.

The image forming device is provided with a process cartridge for the image forming, which is detachably attached to a main body thereof such that consumable supplies such as the photoconductive body and developer are replaced with new ones.

The process cartridge accommodates rotating bodies such as the photoconductive body (drum) and developing roller, which rotating bodies are configured to be rotated by a driving force obtained from the main body of the image forming device. As a configuration for acquiring the driving force from the main body, for example, there is disclosed in Japanese Patent Provisional Publication No. 2000-330455 (hereinafter referred to as '455 Publication), a technique using a joint portion configured to shift in an axial direction thereof. Specifically, in the technique disclosed in '455 Publication, there is provided a drive shaft configured to shift between a state engaging with an input portion of the process cartridge so as to transmit a driving force from a main body to the process cartridge and a state spaced from the input portion of the process cartridge so as to block the transmission of the driving force, which drive shaft is shifted with a cylindrical cam provided with a spiral sliding surface.

The cylindrical cam is joined, via a link, with a door configured to open and close a space housing the process cartridge. Therefor, when the door is opened by a user so as to detach the process cartridge, the cylindrical cam is rotated along with an opening movement of the door, and the drive shaft is retracted toward a main body side such that the driving force is blocked.

Meanwhile, when the process cartridge is completely attached to the main body and the door is closed by the user, the cylindrical cam is rotated along with the operation of closing the door, and the drive shaft is inserted into the input portion such that the driving force is transmitted from the main body to the process cartridge.

SUMMARY

According to the technique disclosed in '455 Publication, the cylindrical cam is rotated with the sliding surface thereof contacting a sliding surface provided to the main body, and thereby shifted in a rotational axis direction.

Thus, in the configuration disclosed in '455 Publication, there is caused oscillation and/or deflection of the link, which joins the cylindrical cam with the door, in the rotational axis direction of the cylindrical cam, as well as oscillation thereof in a plane perpendicular to the rotational axis direction. It results in an undesired problem that a space required for movable portions of a driving mechanism of the drive shaft has to be configured to be larger in consideration of the amount of the oscillation of the link, and thus makes it difficult to downsize the image forming device.

Aspects of the present invention are advantageous in that there are provided one or more improved image forming devices that can be downsized by reducing a space required for movable portions of a driving mechanism that transmits a driving force to each rotating body in a process cartridge thereof.

According to aspects of the present invention, there is provided an image forming device, which includes a housing, a process cartridge detachably attached inside the housing, the process cartridge including an input portion, a door configured to open and close a space accommodating the process cartridge inside the housing, and a driving mechanism provided inside the housing to transmit an inputted driving force to the process cartridge through the input portion, the driving mechanism including, a drive shaft configured to shift along a center axis direction thereof, with respect to the housing, between a first state engaging with the input portion to transmit the driving force to the process cartridge and a second state spaced from the input portion to block transmission of the driving force, a first cam joined with the door to be rotated with respect to the housing in conjunction with movement of the door, the first cam including a first sliding surface, a translation member including a sliding contact portion which slidably contacts the first sliding surface, the translation member being configured to engage with the drive shaft and shift together with the drive shaft along the center axis direction with the sliding contact portion sliding on the first sliding surface in conjunction with rotation of the first cam, and a second cam including a second sliding surface which slidably contacts the sliding contact portion so as to face the first sliding surface through the sliding contact portion.

In some aspects of the present invention, when the door is opened or closed, the first cam is rotated without shifting along a rotational axis direction thereof. At this time, the drive shaft is shifted along the center axis direction thereof in conjunction with the movement of the opened or closed door.

Therefore, in some aspects, the drive shaft can be shifted along the center axis direction without having to shift the first cam along the center axis direction. Hence, there are hardly caused in a joint member that joins the first cam and the door, oscillation and/or deflection in the center axis direction. Thus, since the space required for movable portions of the driving mechanism can be reduced, the image forming device can be downsized.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the invention will be described with reference to the accompanying drawings. It is noted that, in the below-mentioned embodiment, an image forming device according to aspects of the invention will be applied to a monochrome-type laser printer (hereinafter referred to as a printer 1).

1. General Overview of Printer 1

Figure 1:
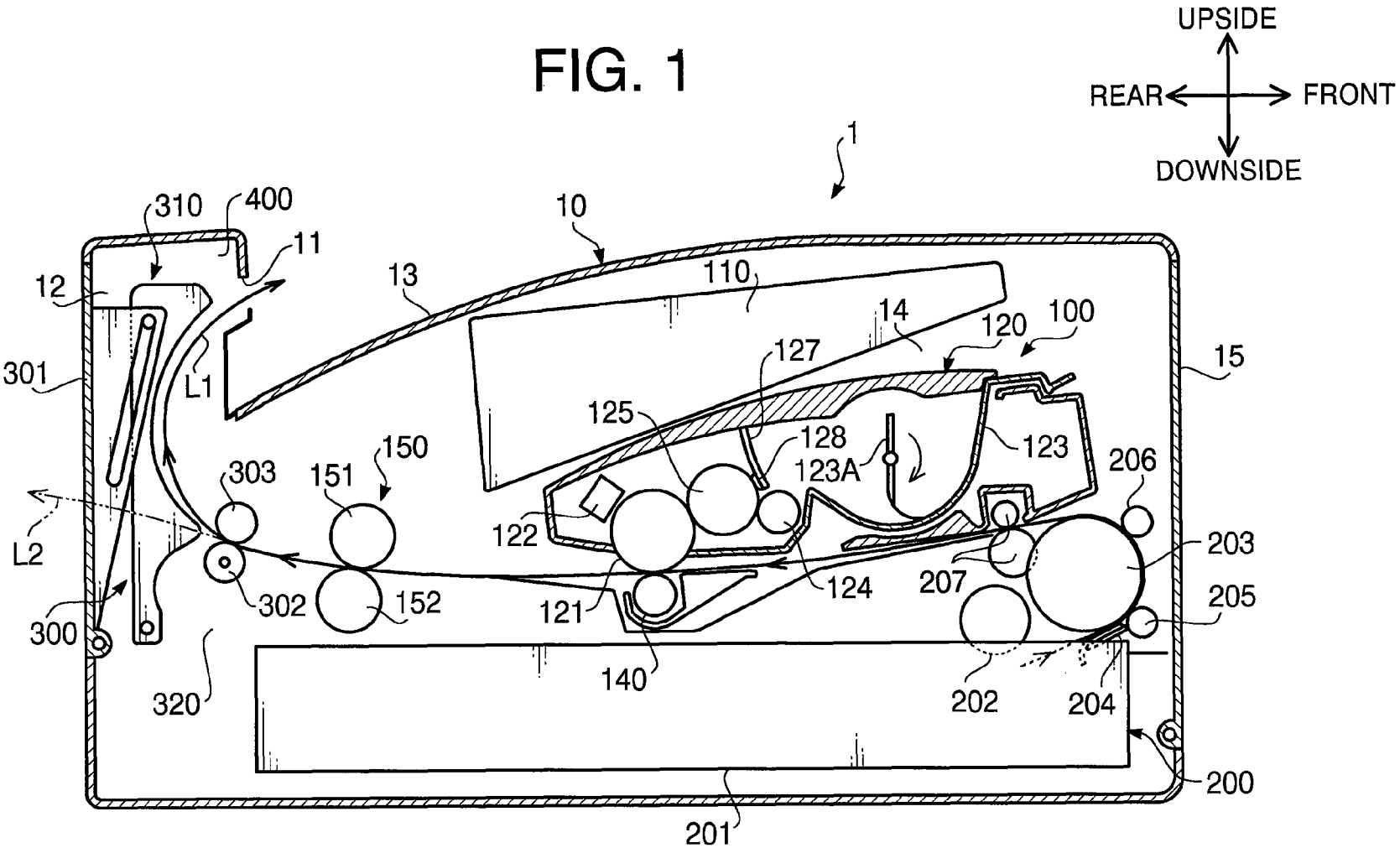
FIG. 1 is a cross-sectional side view schematically showing a main portion of a printer in an embodiment according to one or more aspects of the present invention.
Figure 2A:
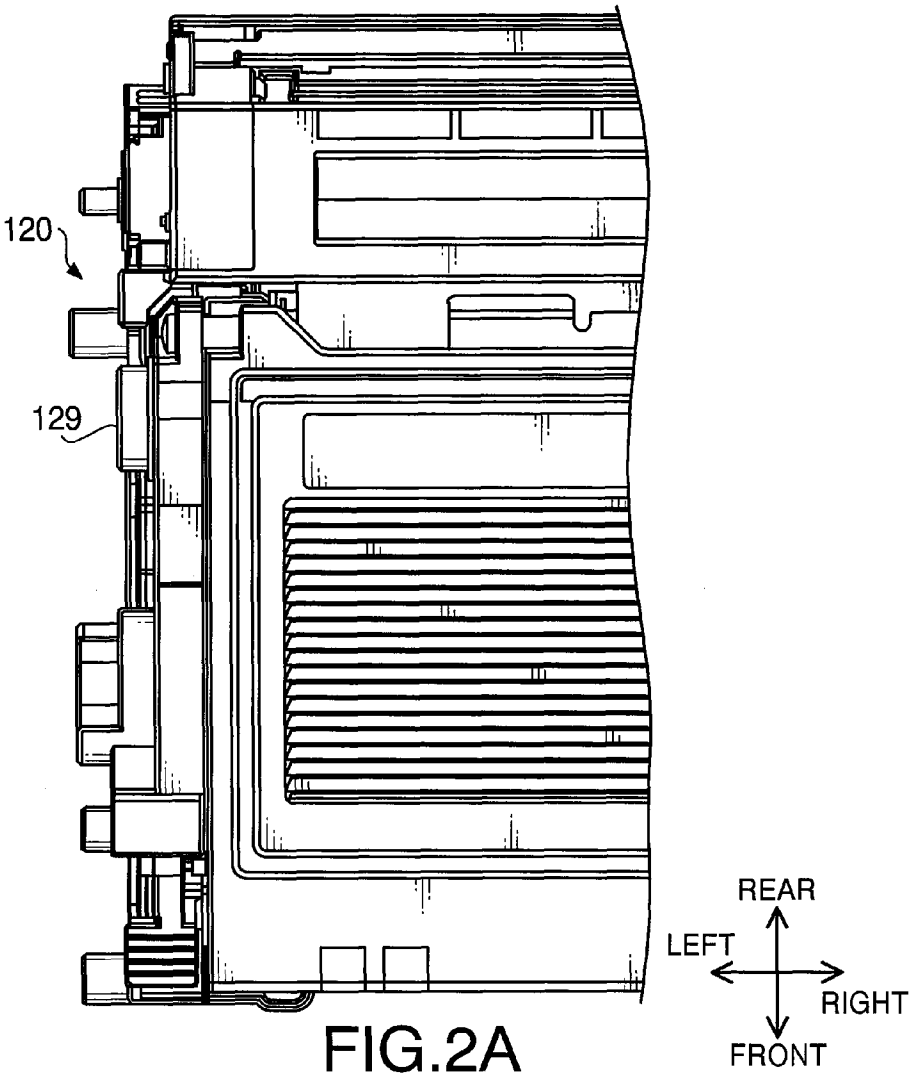
FIG. 2A is a top view of a process cartridge in the embodiment according to one or more aspects of the present invention.
Figure 2B:
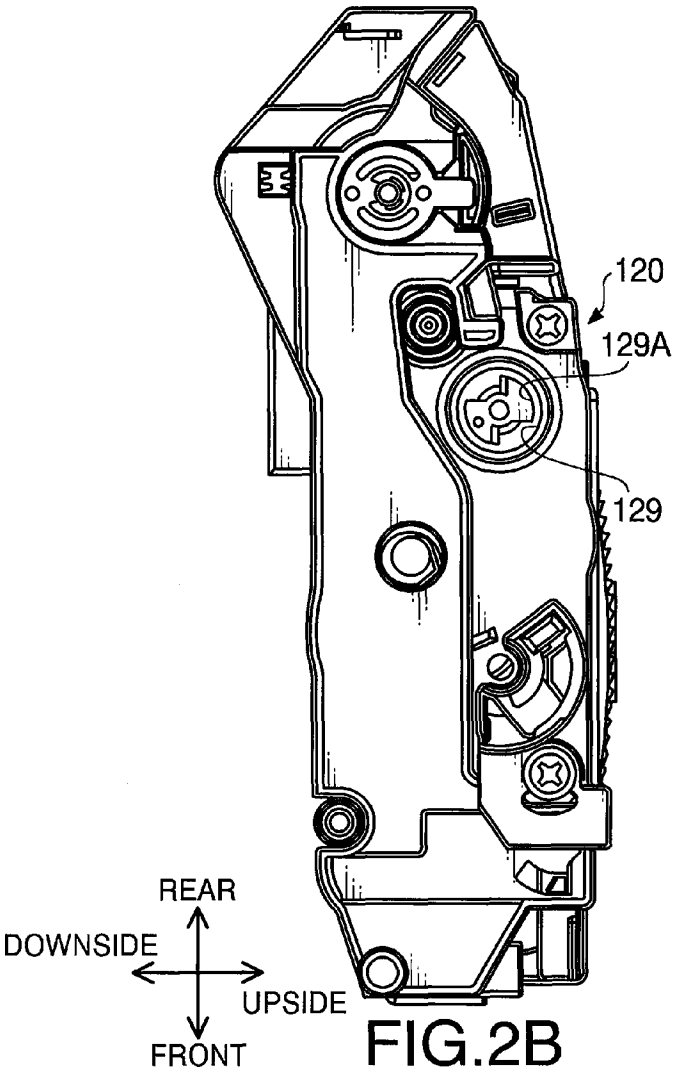
FIG. 2B is a left side view of the process cartridge in the embodiment according to one or more aspects of the present invention.

FIG. 1 is a cross-sectional side view schematically showing a main portion of the printer 1. It is noted that, in FIG. 1, the right side, left side, back side, and front (near) side of the figure are defined as a front side, rear side, right side, and left side of the printer 1, respectively. As shown in FIG. 1, there are provided in a housing 10 of the printer 1, an image forming unit 100 configured to form an image on a recording sheet (hereinafter simply referred to as a sheet) such as a printing paper and OHP transparent sheet, a feeder unit 200 configured to supply the sheet to the image forming unit 100, and a carrying unit configured to convey the sheet with an image completely formed thereon with the image forming unit 100 toward a first discharge portion 11.

In addition, there is provided at a backside of the housing 10, a second discharge portion 12 to discharge the sheet with the image completely formed thereon with the image forming unit 100 and for removing a sheet jammed at the carrying unit 300 or a below-mentioned fixing unit 150. The second discharge portion 12 is closed with a cover 301 rotatably attached to the housing 10 in an openable and closable manner. On the other hand, at an upside of the housing 10, there is provided a catch tray 13 on which at least one of sheets discharged from the first discharge portion 11 is placed.

Further, the printer 1 is provided, as carrying routes for a sheet discharged from the fixing unit 150, with a first carrying route L1 curved in a U-shape from the fixing unit 150 to the catch tray 13 and a second carrying route L2 configured to be substantially linear from the fixing unit 150 to the second discharge portion 12.

Specifically, when the cover 301 is closed, a sheet discharged from the fixing unit 150 is conveyed to the catch tray 13 with having a carrying direction thereof turned substantially 180 degrees around. Meanwhile, when the cover 301 is opened, a sheet discharged from the fixing unit 150 is linearly conveyed with hardly having the carrying direction thereof turned and then discharged from the second discharge portion 12 provided at a downstream side in the carrying direction with respect to a turnaround guide 310.

Further, at a front side of the housing 10, there is provided a door 15 with which a space housing a below-mentioned process cartridge 120 is opened or closed. By opening the door 15, the process cartridge 120 can be attached to and detached from a main body of the image forming device. It is noted that the main body represents a non-movable portion of the image forming device that includes a frame and the housing 10.

Additionally, the image forming unit 100 and carrying unit 300 are fixed to the frame included in the main body, which frame is provided with substantially plate-shaped side frames 400 (see FIG. 3) provided at both ends in a right-to-left direction inside the housing 10, a base plate (not shown) extending in the right-to-left direction so as to link lower end portions of the side frames 400, and a roof plate (not shown) linking upper end portions of the side frames 400.

1.1. Feeder Unit

As shown in FIG. 1, the feeder unit 200 includes a paper feed tray (paper feed cassette) 201, a paper feed roller (pick-up roller) 202 provided at an upper front end portion of the paper feed tray 201 to carry a sheet to the image forming unit 100, a separation roller 203 to separate sheets conveyed by the paper feed roller 202 on a sheet-by-sheet basis, and a separation pad 204.

A first pressing roller 205 and second pressing roller 206 are pressing means configured to rotate keeping contact with the sheet so as to press a sheet to the separation roller 203. A sheet discharged upward from the paper feed tray 201 is conveyed to the image forming unit 100 with having the carrying direction thereof turned substantially 180 degrees around so as to be wound around an outer circumferential surface of the separation roller 203.

At an inlet side of the image forming unit 100 in the sheet carrying route from the paper feed tray 201 to the image forming unit 100, there is provided a pair of registration rollers 207 configured to give a predetermined carrying resistance to a sheet to be conveyed so as to adjust a carrying state of the sheet.

1.2. Image Forming Unit

As shown in FIG. 1, the image forming unit 100 is configured with a laser scanner 110, the process cartridge 120, and the fixing unit 150.

1.2.1. Laser Scanner

The laser scanner 110 is provided at an uppermost portion in the housing 10 to form an electrostatic latent image on a surface of a below-mentioned photoconductive drum 121. Specifically, the laser scanner includes a laser light source (not shown), polygon mirror (not shown), fθ lens (not shown), and reflection mirrors (not shown).

A laser beam emitted by the laser light source is, based on image data, deflected by the polygon mirror, then transmitted through the fθ lens, reflected back and thereafter bent downward by the reflection mirrors, and finally incident onto the surface of the below-mentioned photoconductive drum 121 so as to form an electrostatic latent image thereon.

1.2.2. Process Cartridge

The process cartridge 120 is, as shown in FIG. 1, detachably attached to the main body under the laser scanner 110 in the housing 10. The process cartridge 120 is configured with the photoconductive drum 121, an electrification control device 122, and a developer container 123.

The photoconductive drum 121 is configured to hold developer to be transferred onto a sheet. The electrification control device 122 is configured to electrostatically charge the surface of the photoconductive drum 121. It is noted that there is employed as the electrification control device 122 in the present embodiment, a scorotron-type electrification control device configured to positively charge the surface of the photoconductive drum 121 substantially evenly with the use of corona discharge.

Further, the developer container 123 is configured to accommodate developer (in the present embodiment, powdery toner). The developer container 123 includes therein an agitating unit 132A for agitating the toner therein.

There are provided between the developer container 123 and the photoconductive drum 121, a developing roller 125 and supply roller 124 configured to supply the developer from the developer container 123 to the photoconductive drum 121. The agitating unit 132A, supply roller 124, and developing roller 125 are rotated by a driving force acquired from an electric motor (not shown) provided to the main body via a below-mentioned driving mechanism 500.

It is noted that the agitating unit 132A, supply roller 124, and developing roller 125 are rotated in a synchronized manner through a row of a plurality of gears, while the photoconductive drum 121, which is rotated by a driving force acquired from a driving system different from the driving mechanism 500, is not rotated in synchronization with the agitating unit 132A, supply roller 124, and developing roller 125.

A layer thickness regulating blade 127 is a metal thin plate configured to regulate a layer of the developer held on the surface of the developing roller 125 to have a predetermined thickness. A distal end portion of the layer thickness regulating blade 127 is disposed to face the surface of the developing roller 125 through a thick regulating rubber 128, provided at the distal end portion thereof, which contacts the layer of the developer.

The developer conveyed from the developer container 123 is supplied to the developing roller 125 owing to the rotation of the supply roller 124. The developer supplied to the developing roller 125 is held on the surface of the developing roller 125. The developer held on the surface of the developing roller 125 is regulated by the layer regulating blade 127 to have a predetermined even thickness, and thereafter supplied to the surface of the photoconductive drum 121 exposed by the laser scanner 110.

A transcriptional roller 140 is disposed to face the photoconductive drum 121 through a sheet which is being carried. The transcriptional roller 140 is rotated in conjunction with the rotation of the photoconductive drum 121. The transcriptional roller 140 is configured to charge a surface thereof with an opposite polarity from the charged surface of the photoconductive drum (in the present embodiment, negatively charged), and apply an attractive force generated by the negatively charged surface thereof to the developer on the surface of the photoconductive drum 121 through the sheet from a surface side opposite to a printed surface of the sheet. Thus, the developer adhered onto the surface of the photoconductive body is transferred onto the printed surface of the sheet.

1.2.3. Fixing Unit

As shown in FIG. 1, the fixing unit 150 is disposed at a downstream side in the sheet carrying direction with respect to the photoconductive drum 121 so as to heat, melt, and fix the developer transferred onto the sheet.

Specifically, the fixing unit 150 is configured with a heating roller 151 disposed at the printed surface side of the sheet to heat the developer, and a pressing roller 152 disposed to face the heating roller 151 through the sheet and press the sheet to the heating roller 151 side. The heating roller 151 is rotated by a driving force acquired from an electric motor (not shown). The pressing roller 152 is driven in accordance with the movement of the conveyed sheet.

1.3. Carrying Unit

As shown in FIG. 1, the carrying unit 300 is disposed at the downstream side in the sheet carrying direction with respect to the fixing unit 150 to switch a guide route for the sheet between a first route in which the sheet discharged from the fixing unit 150 is guided toward the first discharge portion 11 and a second route in which the sheet is guided is guided toward the second discharge portion 12. A detailed configuration will be described as follows.

A pair of carrying rollers 302 and 303 is a pair of feed rollers configured to feed the sheet with rotation of the feed rollers caused due to contact with the sheet discharged from the fixing unit 150. A sheet guide 310 is provided at the downstream side in the sheet carrying direction with respect to the carrying rollers 302 and 303. The sheet guide 310 is configured to turn between a first position where the sheet discharged from the carrying rollers 302 and 303 is conveyed into the first carrying route L1 and a second position where the sheet is conveyed into the second carrying route L2.

1.4. Driving Mechanism

Figure 3:
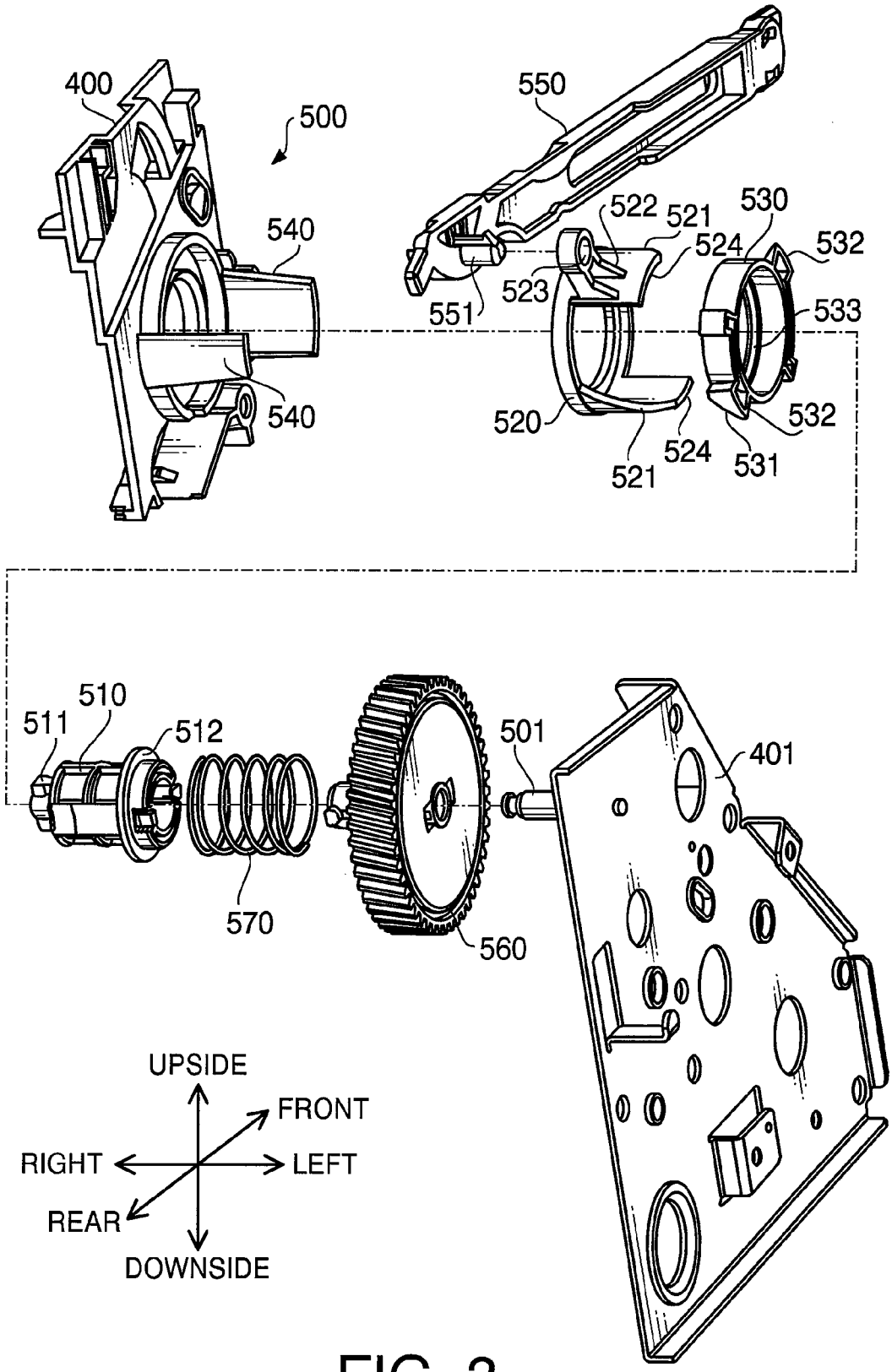
FIG. 3 is a perspective exploded view of a driving mechanism in the embodiment according to one or more aspects of the present invention.
Figure 4:
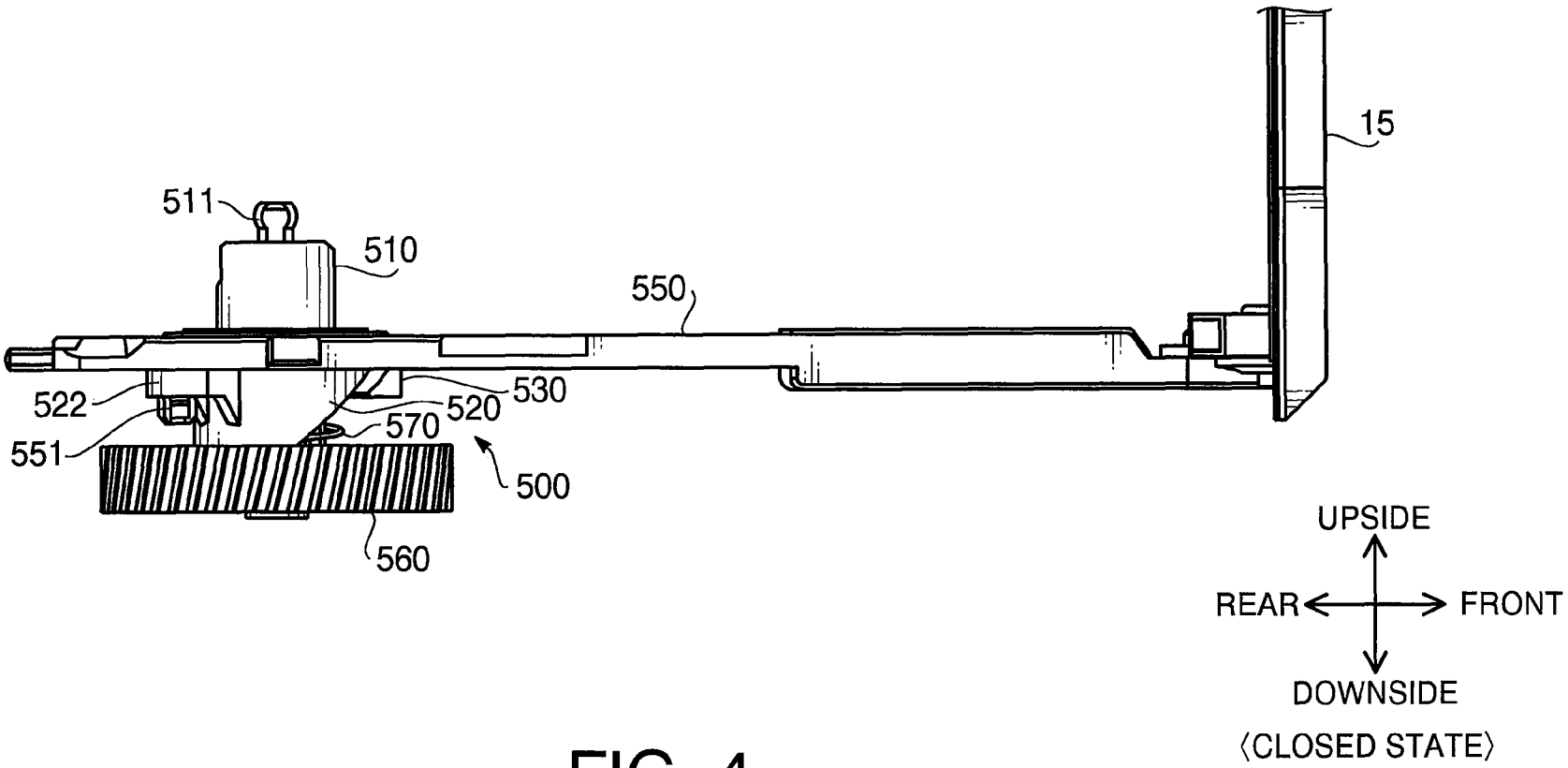
FIG. 4 is a top view showing a state of the driving mechanism when the door is closed in the embodiment according to one or more aspects of the present invention.

FIG. 3 is a perspective exploded view of the driving mechanism 500. As shown in FIG. 3, the driving mechanism 500 is provided at the side frame 400 to keep and block transmission of the driving force to the process cartridge. Specifically, when the door 15 is closed, the driving force can be transmitted. Meanwhile, when the door 15 is opened, the transmission of the driving force is impossible.

In the present embodiment, the driving mechanism 500 is attached to the main body so as to be sandwiched between the resin side frame 400 and a metal reinforcing plate 401. The reinforcing plate 401 includes a supporting shaft 501 for supporting a below-mentioned drive shaft 510 and gear 560. Incidentally, the side frame 400 and reinforcing plate 401 are fixed to each other through a detachable mechanical fastening means such as a screw.

The driving mechanism 500 is, as shown in FIG. 3, configured with the drive shaft 510, a rotating cam 520, a translation cam 530, a regulating cam 540, a link 550, the gear 560, and a spring 570.

The drive shaft 510 is a joint shaft configured to shift along an axial direction of the supporting shaft 501 with respect to the side frame 400 between the state engaging with the input portion 129 (see FIG. 8B) of the process cartridge 120 to transmit the driving force from the main body to the process cartridge 120 and the state spaced from the input portion 129 to block the transmission of the driving force.

The input portion 129 is provided with an engagement hole 129A into which a substantially rectangle engaging portion 511, provided at a distal end of the drive shaft 510, is fitted. When the engaging portion 511 is fitted into the engagement hole 129A, the driving force is transmitted from the drive shaft 510 to the input portion 129 (process cartridge 120).

The rotating cam 520 is connected with the door 15 via the link 550, and rotated around the supporting shaft 501 with respect to the side frame 400 in conjunction with opening and closing movements of the door 15. The rotating cam 520 is provided with a sliding surface 521 (hereinafter referred to as a first sliding surface 521) that is formed in a substantially spiral shape with a rotational axis of the rotating cam 520 as a center axis of the spiral shape.

Figure 11:
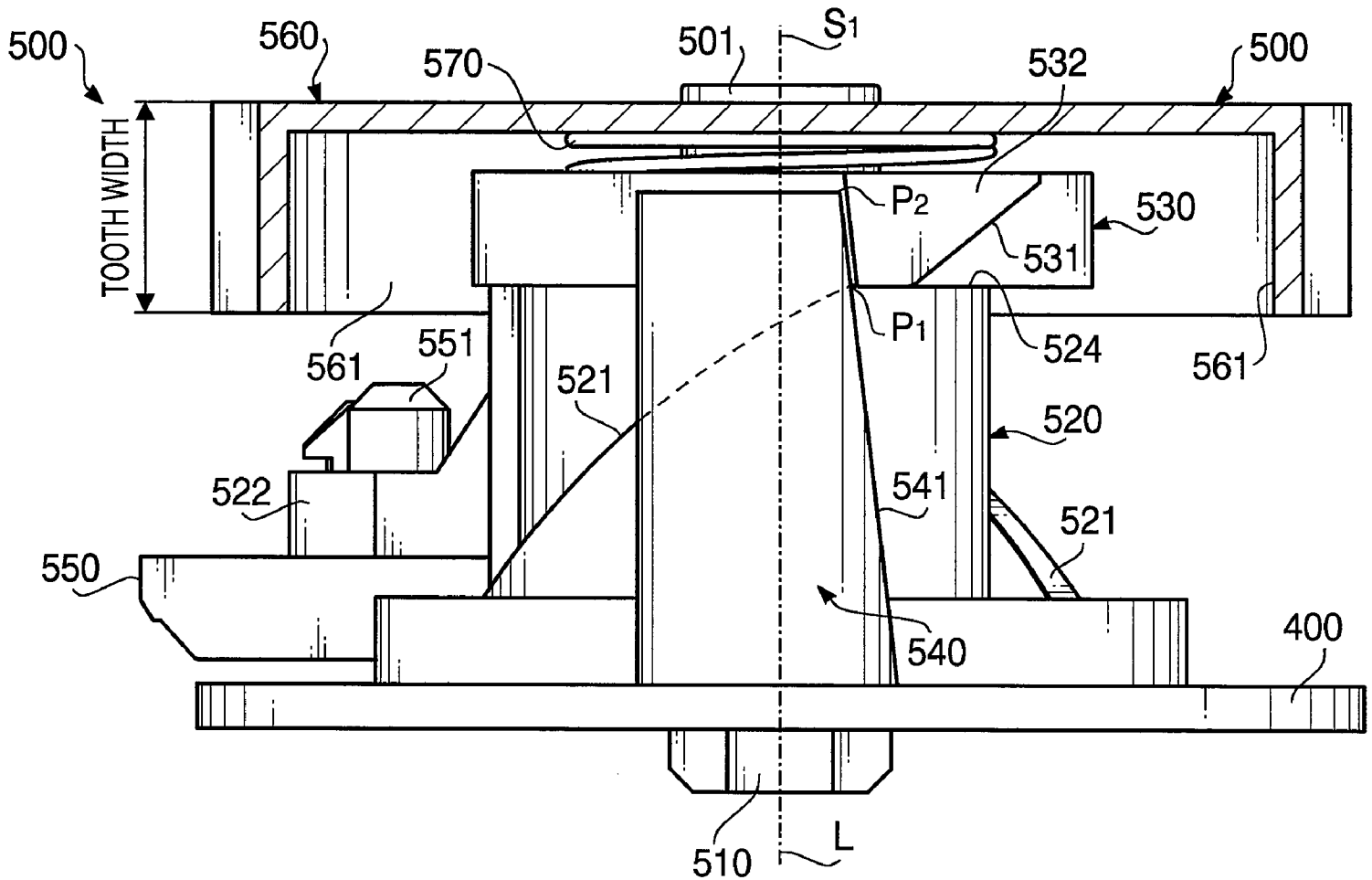
FIG. 11 is an enlarged view of FIG. 9B.

Namely, as shown in FIG. 11, in the case viewed from a direction perpendicular to the figure, the first sliding surface 521 is tilted with respect to a first virtual surface S1 that includes a center axis L and is perpendicular to the figure.

As shown in FIG. 3, the translation cam 530 is a translating member including a sliding contact portion 531 formed with a sliding surface 531 that slidably contacts the first sliding surface 521 of the rotating cam 520, and an engaging portion 533 that engages with a flange portion 512 provided to the drive shaft 510.

Figure 10:
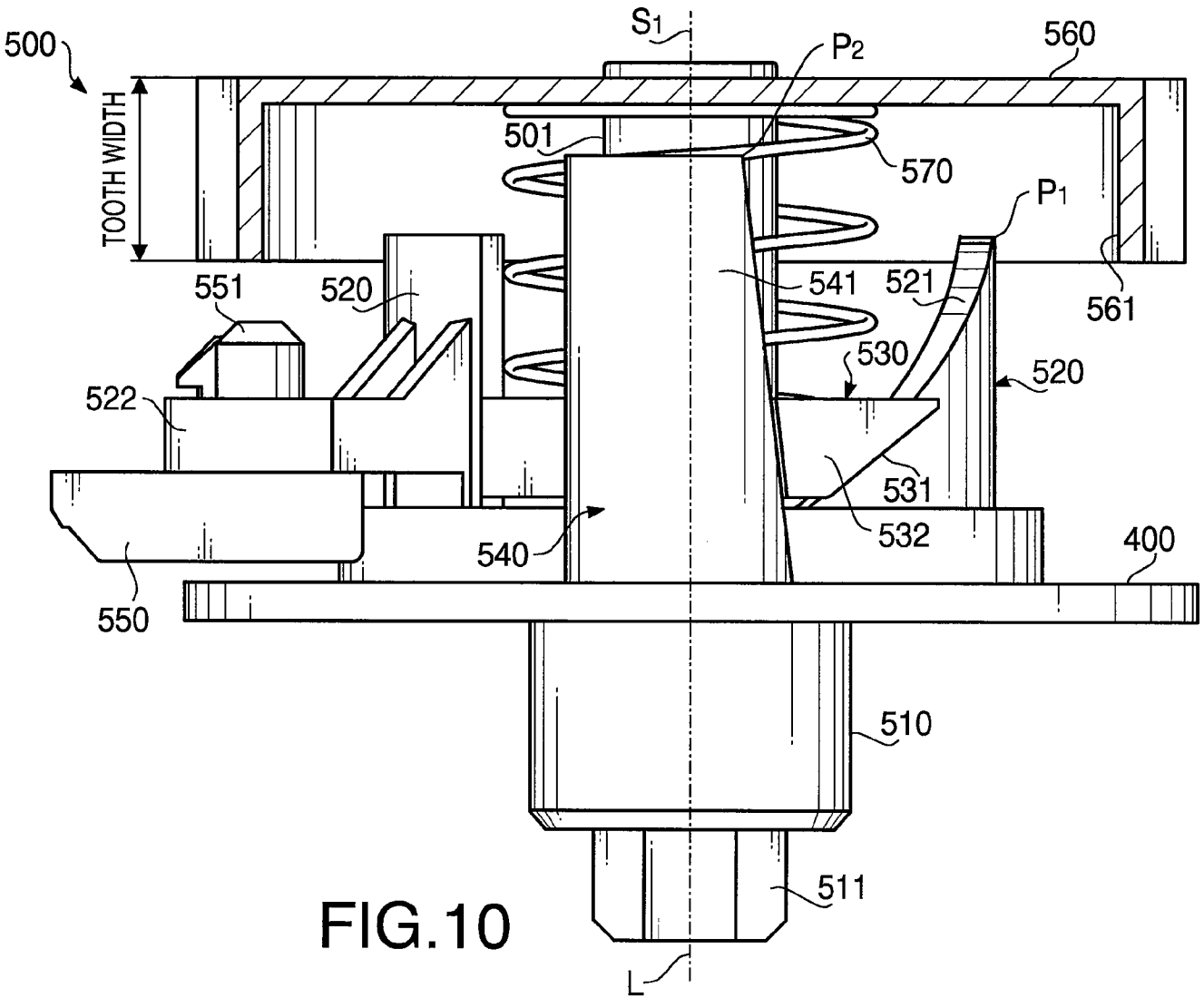
FIG. 10 is an enlarged view of FIG. 8B.

As shown in FIGS. 10 and 11, the translation cam 530 is shifted with the sliding contact portion 532 sliding on the first sliding surface 521 in conjunction with the rotation of the rotating cam 520. Namely, the translation cam 530 is shifted along with the drive shaft 510 in a direction along the center axis L (hereinafter, simply referred to as an axial direction), based on a principle of screw (wedge effect).

As shown in FIG. 10, the regulating cam 540 is provided with a sliding surface (hereinafter referred to as a second sliding surface) 541 that is located so as to face the first sliding surface 521 through the sliding contact portion 532 of the translation cam 530, and configured to slidably contact the sliding contact portion 532.

Figure 8A:
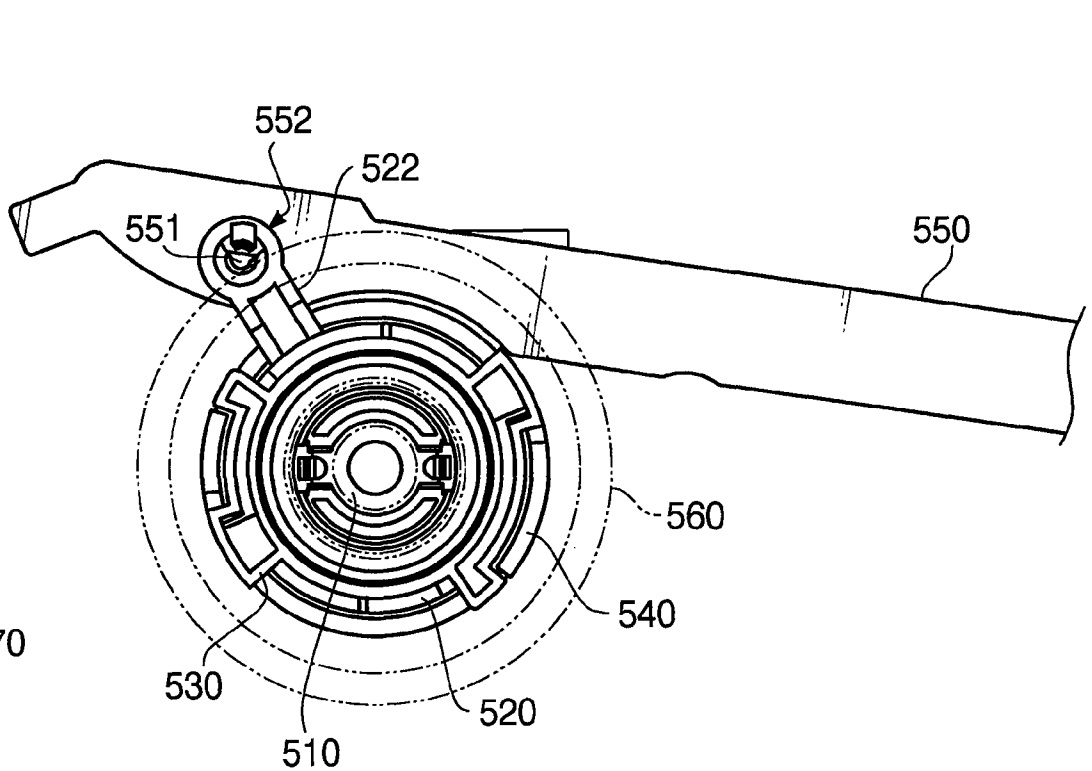
FIG. 8A is a left side view showing the state of the driving mechanism when the door is closed in the embodiment according to one or more aspects of the present invention.
Figure 9A:
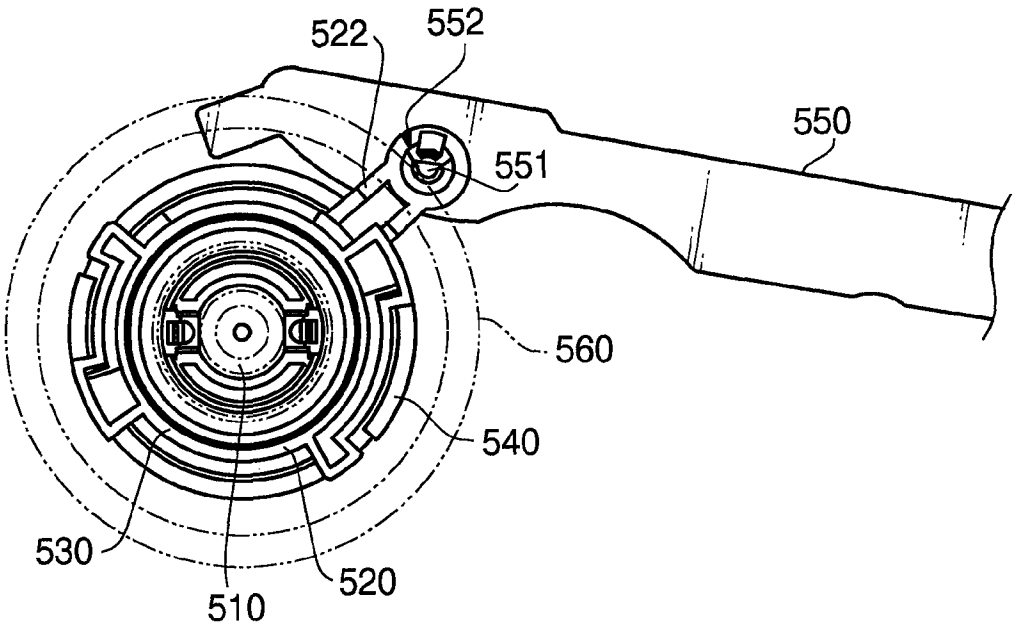
FIG. 9A is a left side view showing the state of the driving mechanism when the door is opened in the embodiment according to one or more aspects of the present invention.

The regulating cam 540 (second sliding surface 541) is integrally fixed to the side frame 400. In addition, as shown in FIGS. 8A and 9A, the regulating cam 540 is placed farther from a rotational center of the rotating cam 520 than the rotating cam 520 (first sliding surface 521) in a radial direction of the rotating cam 520.

In the present embodiment, the second sliding surface 541, the first sliding surface 521, and the sliding surface 531 are provided two pieces each in a rotational symmetric manner. Further, there are concentrically disposed in a following cited order from the rotational center of the rotating cam 520, the rotating cam 520 (first sliding surface 521), the translation cam 530 (sliding surface 531), and regulating cam 540 (second sliding surface 541).

In addition, as shown in FIGS. 10 and 11, the second sliding surface 541 of the regulating cam 540 is tilted with respect to the first virtual surface S1 in a direction opposite to the direction in which the first sliding surface 521 is tilted. Hence, in the case viewed from a direction perpendicular to the figures (a direction that is perpendicular to the center axis L and parallel to the first virtual surface S1), the first sliding surface 521 and second sliding surface 541 are tilted such that a second virtual surface including the first sliding surface 521 intersects with a third virtual surface including the second sliding surface 541 to form a substantially V-shape.

Thus, when the rotating cam 520 is rotated, an end point P1 of the first sliding surface 521 and an end point P2 of the second sliding surface 541 get away from or close to one another. Therefore, as shown in FIGS. 10 and 11, the translation cam 530 is shifted in conjunction with the rotation of the rotating cam 520 to shift the drive shaft 510 in the axial direction.

Figure 5:
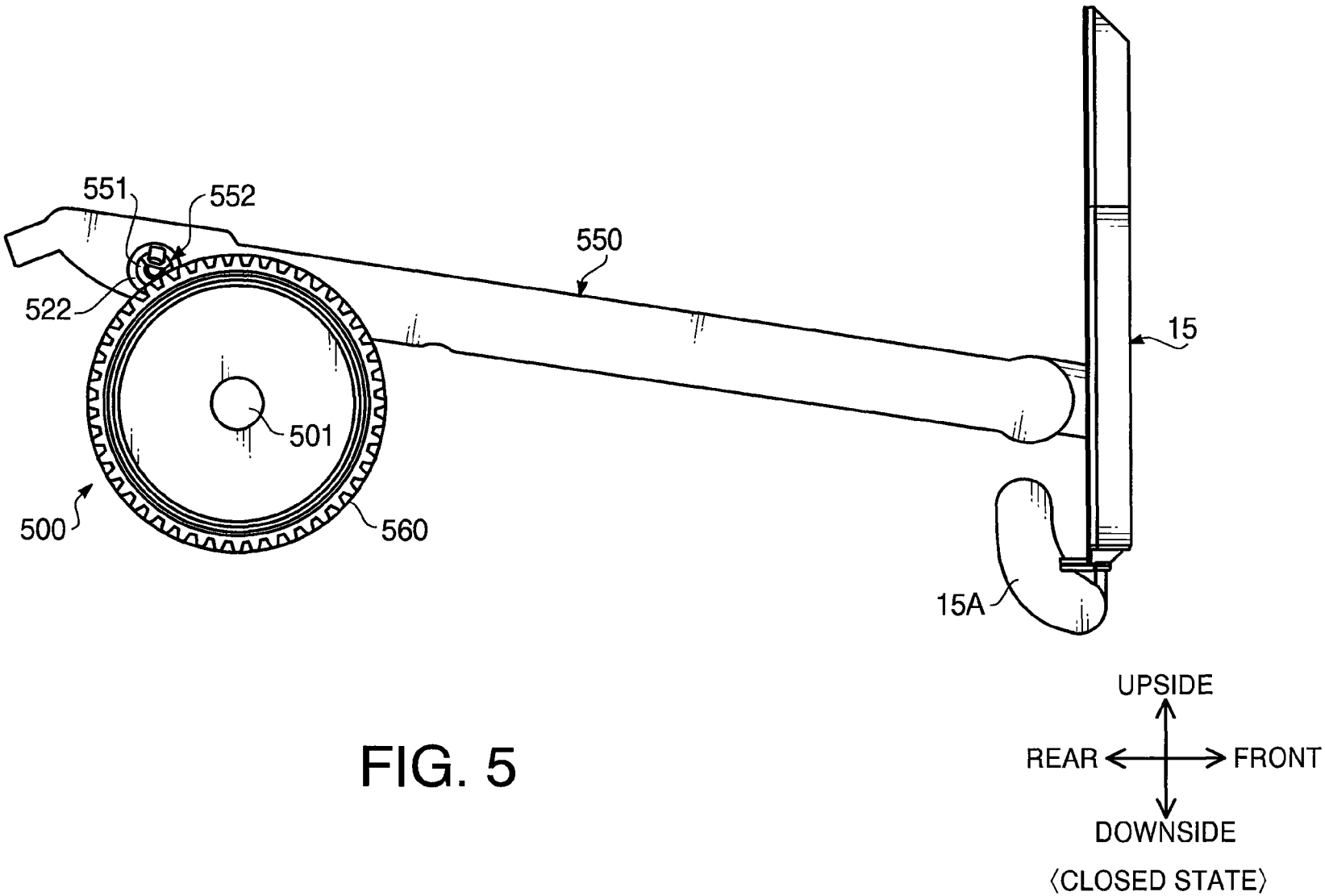
FIG. 5 is a left side view showing the state of the driving mechanism when the door is closed in the embodiment according to one or more aspects of the present invention.
Figure 6:
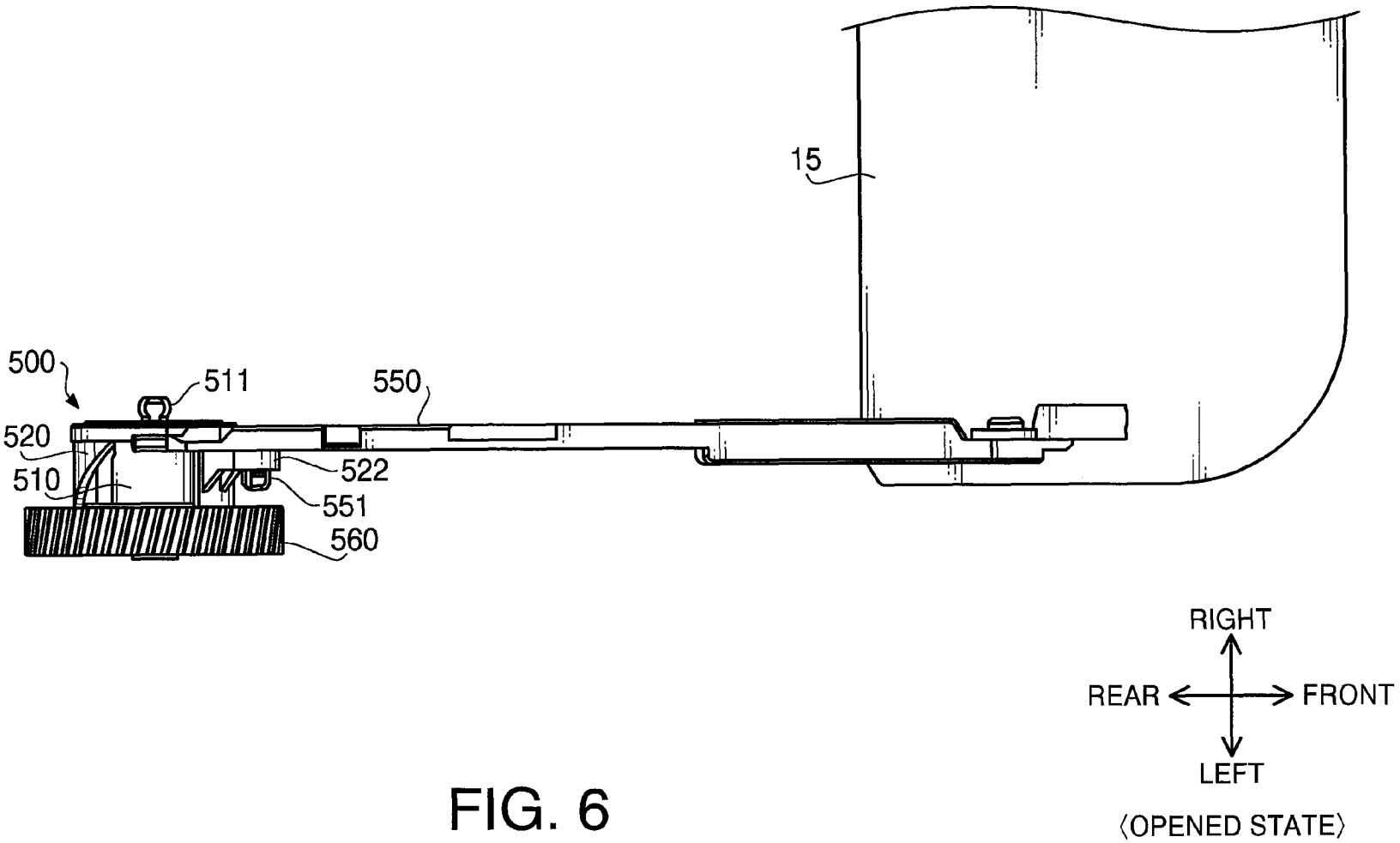
FIG. 6 is a top view showing a state of the driving mechanism when the door is opened in the embodiment according to one or more aspects of the present invention.
Figure 7:
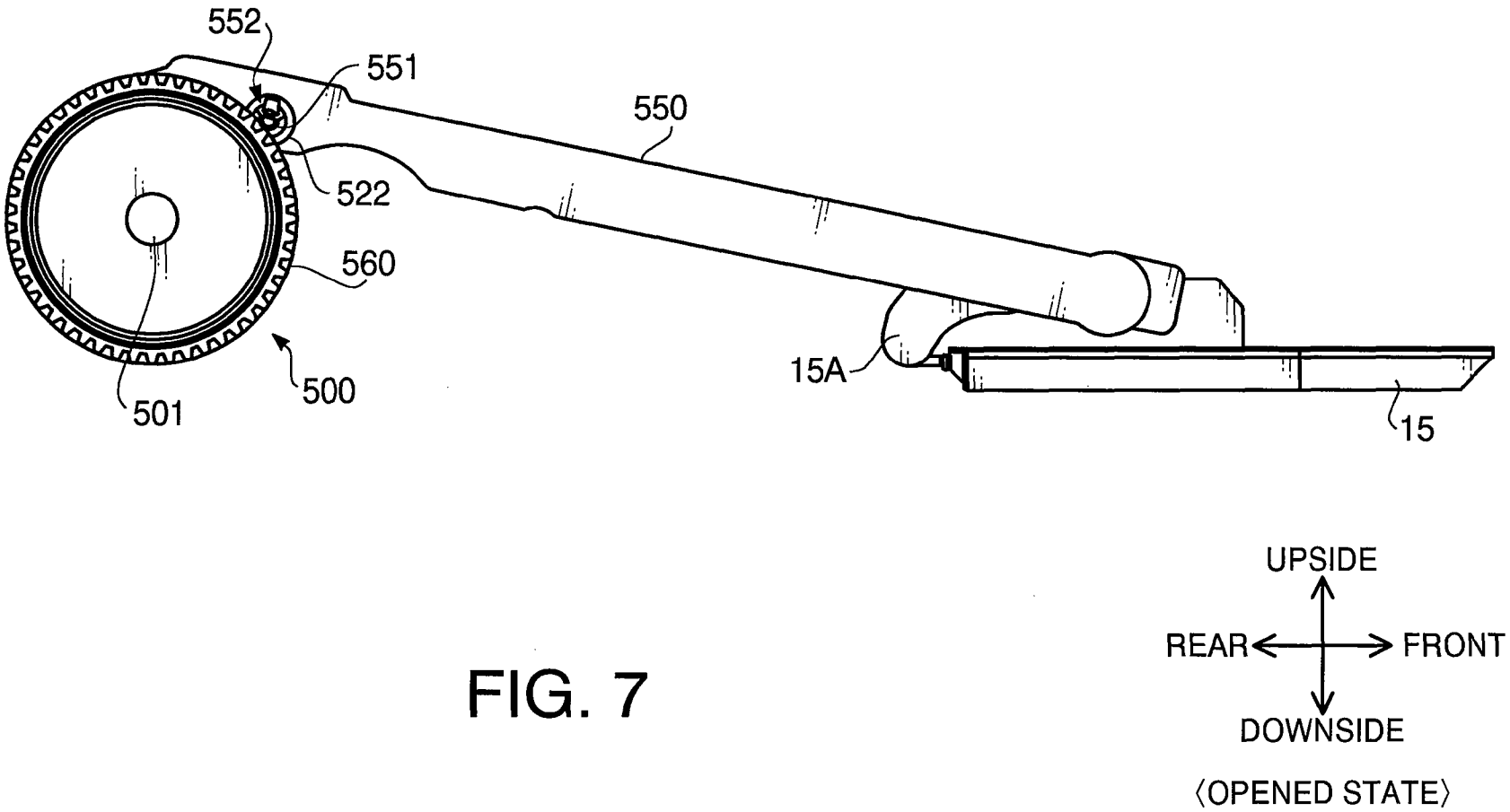
FIG. 7 is a left side view showing the state of the driving mechanism when the door is opened in the embodiment according to one or more aspects of the present invention.

As shown in FIGS. 5 and 7, the link 550 is configured as a joining member with a first end thereof rotatably attached to the rotating cam 520 and the other second end rotatably attached to a hinge 15A of the door 15. With the link 550 configured as above, the opening and closing operations are converted into rotational movements of the rotating cam 520.

As shown in FIG. 3, there is provided at the first end side of the link 550, a boss 551 formed in a pin-shape. On the other hand, the rotating cam 520 is provided with an arm portion 522 extending outward in the radial direction beyond the regulating cam 540. With the boss 551 being rotatably inserted into ajoining hole 523 formed at a distal end side of the arm portion 522, the rotating cam 520 is rotatably joined with the link 550.

In addition, the gear 560 is a disk-shaped helical gear configured to provide the driving force transmitted from the aforementioned electric motor to the drive shaft 510. Further, as shown in FIGS. 5 and 7, at least part of a joint portion 552 of the link 550 with the rotating cam 520 overlaps the gear 560 in the case viewed from a rotational axis direction of the gear 560.

Further, as shown in FIGS. 10 and 11, the gear 560 includes a recess portion 561 on a side face at the drive shaft 510 side, which recess portion 561 is recessed from an end of the above side face of the gear 560 in the rotational axis direction. The supporting shaft 501 and drive shaft 510 are designed such that the sliding contact portion 532 of the translation cam 530 is located within the recess portion 561 when the translation cam 530 gets the closest to the gear 560, as shown in FIG. 11.

The spring 570 is configured to bias the drive shaft 510 against the translation cam 530 and give the drive shaft 510 a force to have the drive shaft spaced away from the gear 560. Therefore, the drive shaft 510 is shifted in the axial direction, integrally with the translation cam 530, so as to be sandwiched between the translation cam 530 and spring 570.

Figure 8B:
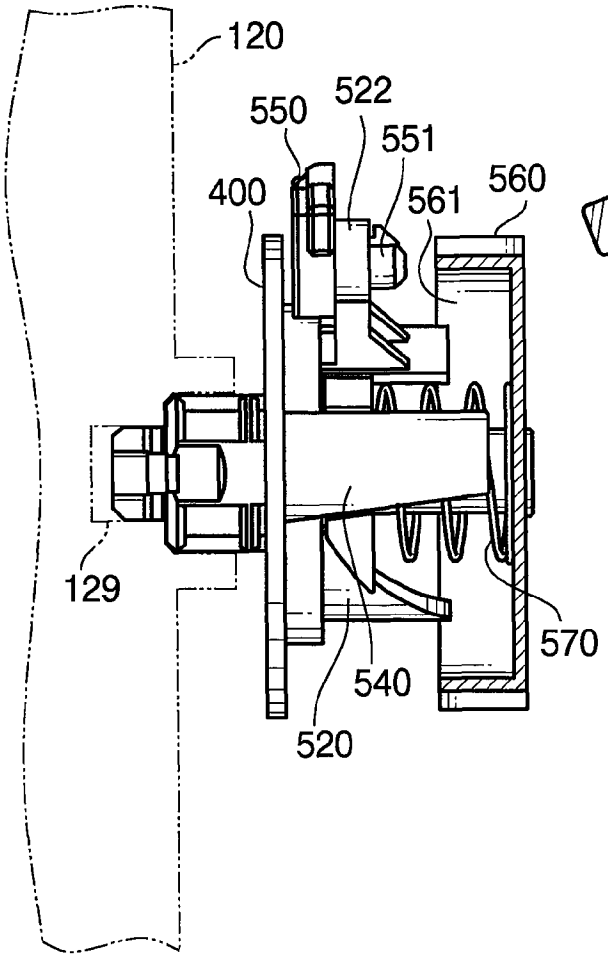
FIG. 8B is a rear side view showing the state of the driving mechanism when the door is closed in the embodiment according to one or more aspects of the present invention.

2. Features of Laser Printer (Particularly, Driving Mechanism) in the Embodiment In the present embodiment, as shown in FIGS. 8B and 10, in a state where the door 15 is closed, the end point P1 of the first sliding surface 521 is spaced from the end point P2 of the second sliding surface 541. Therefore, due to an elastic force of the spring 570, the translation cam 530 gets away from the gear 560 and close to the process cartridge 120.

Therefore, the drive shaft 510 comes into a state inserted into the input portion 129 of the process cartridge 120, and thereby the driving force can be transmitted from the driving mechanism 500 to the process cartridge 120.

Figure 9B:
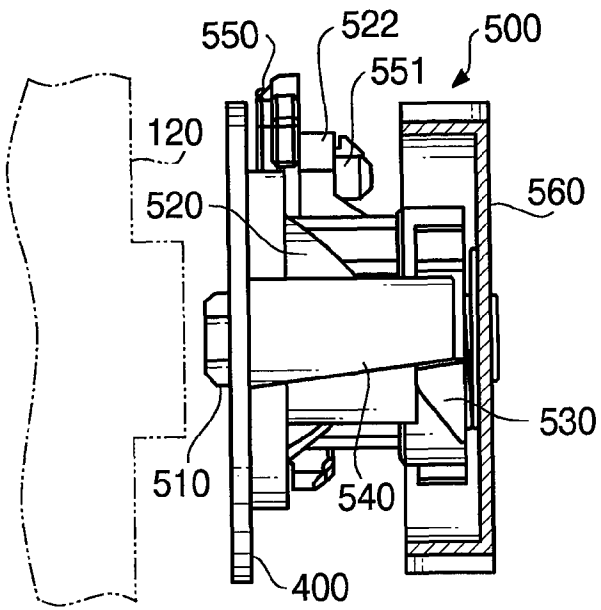
FIG. 9B is a rear side view showing the state of the driving mechanism when the door is opened in the embodiment according to one or more aspects of the present invention.

Meanwhile, when the door 15 is opened, the rotating cam 520 is thereby rotated, and the end point P1 of the first sliding surface 521 gets close to the end point P2 of the second sliding surface 541. Thus, as shown in FIGS. 9B and 11, the translation cam 530 is shifted to get close to the gear 560 against the elastic force of the spring 570 with the sliding contact portion 532 sliding between the first sliding surface 521 and second sliding surface 541.

Therefore, the drive shaft 510 is spaced away from the process cartridge 120 to be ejected from the input portion 129. Thus, the driving force can not be transmitted from the driving mechanism 500 to the process cartridge 120.

It is noted that, in the present embodiment, when the door 15 is opened at a predetermined angle, the sliding contact portion 532 of the translation cam 530 gets over the first sliding surface 521 and then upon a holding surface 524 continuing into the first sliding surface 521.

The holding surface 524 is a surface perpendicular to the axial direction or a surface tilted with respect to the first virtual surface S1 in a direction opposite to the direction in which the first sliding surface 521 is tilted. When the sliding contact portion 532 gets over the holding surface 524, even though the elastic force is applied by the spring 570, the translation cam 530 (drive shaft 510) maintains its previous state without shifting to the process cartridge 120 side.

As having been described above, in the present embodiment, when the door 15 is opened or closed, the rotating cam 520 is rotated without being shifted in the axial direction. At this time, the drive shaft 510 is shifted along the center axis direction thereof in conjunction with the opening and closing movements of the door 15.

Accordingly, in the present embodiment, the drive shaft 510 can be shifted in the center axis direction without having to shift the rotating cam 520 in the center axis direction. Hence, there are hardly caused oscillation and/or deflection of the link 550 joining the rotating cam 520 with the door 15. Thereby, since a movable space required for the driving mechanism can be reduced, the image forming device can be downsized.

Meanwhile, the center axis direction and the rotational direction the rotating cam 520 are perpendicular to each other. Hence, the smaller is an angle between the first virtual surface S1 and either the first sliding surface 521 or the second sliding surface 541, the weaker is the force acting in the axial direction (i.e., direction along the center axis L) on a contact surface between the sliding contact portion 532 and each of the first sliding surface 521 and the second sliding surface 541. Therefore, a force for shifting the drive shaft 510 gets weaker.

Meanwhile, since a force for rotating the rotating cam 520 is generated owing to an operating force for opening and closing the door 15, the force for operating the door 15 has to be greater as the force for shifting the drive shaft 510 gets smaller.

On the contrary, in the present embodiment, both the first sliding surface 521 and the second sliding surface 541 are tilted with respect to the first virtual surface S1. Thus, the translation cam 530, that is, the drive shaft 510 can smoothly be shifted along the center axis direction without having to make the force for operating the door 15 greater.

Meanwhile, since a torque acting on the rotating cam 520 is identical to a torque acting on the regulating cam 540. Therefore, when the regulating cam 540 is placed farther from the rotational center of the rotating cam 520 than the rotating cam 520 in the radial direction of the rotating cam 520 as described above in the present embodiment, a force causing the torque acting on the regulating cam 540 is smaller than that causing the torque acting on the rotating cam 520. Accordingly, even though the size of the regulating cam 540 is reduced, sufficient mechanical strength therefor can be attained.

Additionally, when the regulating cam 540 is fixed to the side frame 400 as described above in the present embodiment, a rotational stroke of the rotating cam 520 is defined by an rotational angle permitted until the joint portion 552 (arm portion 522) of the link 550 with the rotating cam 520 collides the regulating cam 540.

Therefore, when the size of the regulating cam 540 is reduced, the rotational angle permitted until the joint portion 552 collides the regulating cam 540 is wider. Thus, greater rotational stroke of the rotating cam 520 can be attained, and it leads to that the force for operating the door 15 can be weakened.

Further, in the present embodiment, the regulating cam 540 is fixed to the side frame 400. Therefore, since it is not required to secure a movable space for the regulating cam 540, a movable space required for the driving mechanism 500 can be reduced.

Further, since the rotating cam 520 is placed inside the regulating cam 540 fixed, other components can be disposed in the other areas at the same radius location as the regulating cam 540. Therefore, the image forming device can be downsized such that a footprint thereof in the radial direction of the rotating cam 520 is saved.

Meanwhile, as described above, the smaller is the angle between the first virtual surface S1 and the first sliding surface 521 or second sliding surface 541, the greater is the force for operating the door 15. However, the greater is the angle between the first virtual surface S1 and the first sliding surface 521 or second sliding surface 541, the greater rotational angle of the rotating cam 520 is required for a predetermined shift amount of the drive shaft 510. It results in that the rotational stroke of the rotating cam 520 has to be enlarged.

However, the rotational stroke of the rotating cam 520 is regulated by the collision between the joint portion 552 (arm portion 522) of the link 550 with the rotating cam 520 and the regulating cam 540. Hence, it is difficult to secure a great rotational stroke.

In the present embodiment, since the angle between the first virtual surface S1 and the first sliding surface 521 is configured to be greater than the angle between the first virtual surface S1 and the second sliding surface 541, it can be avoided without having to secure an excessively large rotational stroke to make the force of operating the door 15 great.

Further, in the present embodiment, at least part of the joint portion 552 of the link 550 with the rotating cam 520 overlaps the gear 560 in the rotational axis direction of the gear 560. Therefore, the driving mechanism 500 can be downsized in the radial direction of the gear 560.

Additionally, in the present embodiment, there is provided on the side face of the gear 560 at the drive shaft 510 side, the recess portion 561 recessed from the end of the gear 560 at the above side face side in the rotational axis direction. Further, when the translation cam 530 is located the closest to the gear 560, the sliding contact portion 532 is placed within the recess portion 561. Therefore, a space within the recess portion 561 can efficiently be utilized.

Accordingly, without having to reduce the shift amount of the drive shaft 510, the driving mechanism 500 can be downsized in the center axis direction. Or without having to enlarge the size of the driving mechanism 500 in the center axis direction, it is possible to increase the tooth width of the gear 560.

Further, in the present embodiment, the holding surface 524 continuing into the first sliding surface 521 is provided at an end of the first sliding surface 521 in the translating direction of the translation cam 530. In addition, the holding surface 524 is configured to be perpendicular to the axial direction or to be tilted with respect to the first virtual surface S1 in the opposite direction from the direction in which the first sliding surface 521 is tilted. Thereby, the states of the translation cam 530 (drive shaft 510) and the door 15 when the door 15 is opened can be held, even though the elastic force is applied by the spring 570.

Thus, since a user does not have to hold the opened states when the user opens the door 15, the user can easily perform operations of attaching and detaching the process cartridge 120.

(Modifications)

In the aforementioned embodiment, any of the first sliding surface 521 and second sliding surface 541 is tilted with respect to the first virtual surface S1. However, the present invention is not limited to such a configuration only one of the first sliding surface 521 and second sliding surface 541 may be tilted with respect to the first virtual surface S1.

Further, in the aforementioned embodiment, the first sliding surface 521 is more tilted with respect to the first virtual surface S1 than the second sliding surface 541. However, on the contrary, the second sliding surface 541 may be more tilted with respect to the first virtual surface S1 than the first sliding surface 521.

Additionally, in the aforementioned embodiment, the regulating cam 540 is fixed to the side frame 400. However, the present invention is not limited to such a configuration, and the regulating cam 540 may be rotated and shifted in conjunction with the opening and closing movements of the door 15.

Furthermore, in the aforementioned embodiment, the regulating cam 540 is placed farther from the rotational center of the rotating cam 520 than the rotating cam 520. However, the present invention is not limited to such a configuration, and on the contrary, the rotating cam 520 is placed farther from the rotational center of the rotating cam 520 than the regulating cam 540.

Further, in the aforementioned embodiment, the gear 560 is provided with the recess portion 561, and the sliding contact portion 532 is located within the recess portion 561 when the translation cam 530 gets the closest to the gear 560. However, the present invention is not limited to such a configuration.

In addition, in the aforementioned embodiment, at least part of the joint portion 552 of the link 550 with the rotating cam 520 overlaps the gear 560 in the axial direction. However, the present invention is not limited to such a configuration.

Further, in the aforementioned embodiment, the photoconductive drum 121 acquires the driving force from a different route from the driving mechanism 500. However, the present invention is not limited to such a configuration, and the photoconductive drum 121 may be configured to acquire the driving force from the driving mechanism 500.

Further, in the aforementioned embodiment, the laser beam scanner is employed as the exposure unit. However, the present invention is not limited to such a configuration, and may be applied to an electrophotographic image forming device provided with an LED as a light source of the exposure unit.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a housing;

a process cartridge detachably attached inside the housing, the process cartridge including an input portion;

a door configured to open and close a space accommodating the process cartridge inside the housing; and a driving mechanism provided inside the housing to transmit an inputted driving force to the process cartridge through the input portion, the driving mechanism including:

a drive shaft configured to shift along a center axis direction thereof, with respect to the housing, between a first state engaging with the input portion to transmit the driving force to the process cartridge and a second state spaced from the input portion to block transmission of the driving force;

a first cam joined with the door to be rotated with respect to the housing in conjunction with movement of the door, the first cam including a first sliding surface;

a translation member including a sliding contact portion which slidably contacts the first sliding surface, the translation member being configured to engage with the drive shaft and shift together with the drive shaft along the center axis direction with the sliding contact portion sliding on the first sliding surface in conjunction with rotation of the first cam; and a second cam including a second sliding surface which slidably contacts the sliding contact portion so as to face the first sliding surface through the sliding contact portion.

2. The image forming device according to claim 1, wherein the translation member is configured to shift along the center axis direction with a first point on the first sliding surface being shifted with respect to a second point on the second sliding surface along a rotational direction of the first cam in conjunction of the rotation of the first cam.

3. The image forming device according to claim 2, wherein at least one of the first sliding surface and the second sliding surface is tilted with respect to the center axis direction.

4. The image forming device according to claim 3, wherein the first sliding surface and the second sliding surface are tilted in opposite directions with respect to the center axis direction.

5. The image forming device according to claim 4, wherein the first sliding surface is tilted with respect to the center axis direction at a greater absolute angle than the second sliding surface.

6. The image forming device according to claim 1, wherein the second cam is fixed with respect to the housing and placed farther from a rotational center of the first cam than the first cam in a radial direction of the first cam.

7. The image forming device according to claim 1, wherein the driving mechanism further includes:

a gear configured to be rotated around a rotational axis thereof by the inputted driving force so as to transmit the driving force to the drive shaft; and a joint member configured to join the first cam and the door are joined therethrough, and wherein the gear overlaps at least part of the joint member in a direction along the rotational axis of the gear.

8. The image forming device according to claim 7, wherein the gear includes a recess portion on a side face thereof at a side of the drive shaft, the recess portion being recessed from an end of the side face of the gear in the direction along the rotational axis, and wherein, when the translation member gets the closest to the gear, the sliding contact portion is located within the recess portion.

9. The image forming device according to claim 1, further comprising a frame inside the housing, wherein the driving mechanism is provided to the frame.

10. The image forming device according to claim 1, wherein the translation member includes an engagement portion, wherein the drive shaft includes a flange portion, and wherein the translation member engages with the drive shaft through the engagement portion thereof engaging with the flange portion.

* * * * *